US005209806A

United States Patent [19]

Hibberd

[11] Patent Number: 5,209,806

[45] Date of Patent: May 11, 1993

[54] ENVELOPE SEALING DEVICE

[75] Inventor: Christopher V. Hibberd, Essex, England

[73] Assignee: Pitney Bowes PLC, Harlow, United Kingdom

[21] Appl. No.: 694,181

[22] Filed: May 1, 1991

[30] Foreign Application Priority Data

May 3, 1990 [GB] United Kingdom ..... 9009961

[51] Int. Cl.[5] ..... B43M 5/00

[52] U.S. Cl. ..... 156/441.5; 118/264; 118/268; 156/442.1

[58] Field of Search ..... 156/441.5, 442.1, 442.2, 156/442.3; 118/264, 268, 429; 137/423, 424, 425

[56] References Cited

U.S. PATENT DOCUMENTS

| | | | |
|---|---|---|---|
| 533,948 | 2/1895 | Dempsey | 156/441.5 |
| 595,491 | 12/1897 | Moseley | 118/268 |
| 799,304 | 9/1905 | Cox | 156/441.5 |
| 1,633,244 | 6/1927 | Eskholme | 156/442.1 |
| 1,633,698 | 6/1927 | Davis . | |
| 1,970,460 | 8/1934 | Kirshner | 156/441.5 |
| 2,121,166 | 6/1938 | Flynt | 156/441.5 |
| 2,167,252 | 7/1939 | Rouan et al. . | |
| 2,167,257 | 7/1939 | Wheeler . | |
| 2,349,564 | 5/1944 | Ryan et al. | 118/264 |
| 3,353,513 | 11/1967 | Schmitt | 118/264 |
| 3,811,407 | 5/1974 | Lupkas et al. | 118/264 |
| 3,905,325 | 9/1975 | Labore et al. | 118/8 |
| 4,050,315 | 9/1977 | Markfelt | 73/425.4 |
| 4,371,416 | 2/1983 | Denzin | 156/441.5 |
| 4,450,037 | 5/1984 | Gavronsky | 156/441.5 |
| 4,903,633 | 2/1990 | Nobile et al. | 118/268 |

FOREIGN PATENT DOCUMENTS

| | | |
|---|---|---|
| 1516437 | 3/1968 | France . |
| 2195532 | 3/1974 | France . |
| 2246401 | 5/1975 | France . |

*Primary Examiner*—David A. Simmons
*Assistant Examiner*—William J. Matney, Jr.
*Attorney, Agent, or Firm*—Charles G. Parks, Jr.; Melvin J. Scolnick

[57] ABSTRACT

An envelope sealing and feeding device has upper and lower interfitting parts defining a reservoir for a liquid to be used in the sealing operation and a substantially horizontal slot through which an envelope to be sealed can be fed. These parts co-operate with a wetter assembly which includes a wetter blade extending across the slot and a tubular structure containing wicking material and extending substantially vertically downwardly through the upper part and into the liquid reservoir.

With this arrangement, replacement of the wetter assembly is made easier. Assembly and dis-assembly of the relevant parts of the machine in order to obtain access to the interior of the liquid reservoir can be done without difficulty. The upper and lower parts can be joined together readily merely by using two bolts or screws, and once joined the wetter assembly can be added easily due to the simple structure, which allows easy preparation of the sub-assembly and then straightforward insertion of a tubular structure thereof in a slot in the upper part. In addition, attachment of the envelope sealer-feeder device onto a postage meter is made particularly easy by the use of a bracket.

2 Claims, 4 Drawing Sheets

FIG.1.
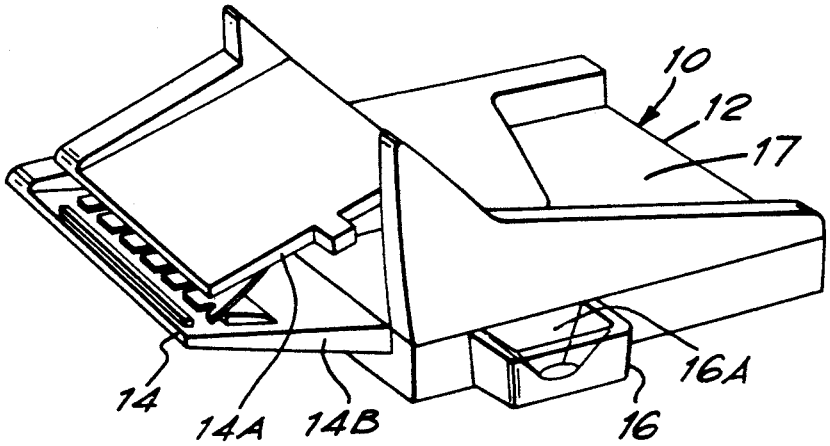
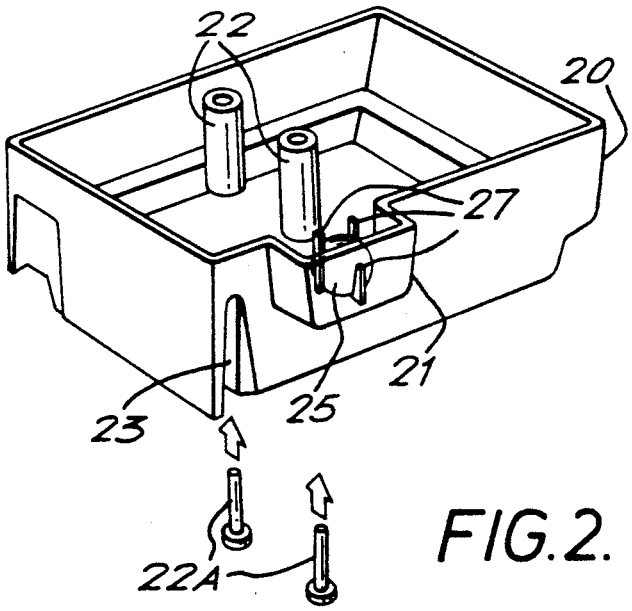
FIG.2.

ENVELOPE SEALING DEVICE

BACKGROUND OF THE INVENTION

This invention relates to an envelope sealing device. Such devices are often known as sealer-feeders and are attached to or made as part of a postage meter. Envelope sealer-feeders may also find application in packaging machines or mailing machines or other environments where envelopes have to be sealed closed.

One of the problems in many current designs of envelope sealer devices is that their attachment and detachment from a postage meter is troublesome, and that their assembly in manufacture is complicated due to the large number of parts. It is an aim of the present invention to overcome or greatly reduce these difficulties.

SUMMARY OF THE INVENTION

According to the invention, there is provided an envelope sealing and feeding device comprising upper and lower interfitting parts defining a reservoir for a liquid to be used in the sealing operation and a substantially horizontal slot through which an envelope to be sealed can be fed, these parts co-operating with a wetter assembly which includes a wetter blade extending across the slot and a tubular structure containing wicking material and extending substantially vertically downwardly through the upper part and into the liquid reservoir.

In a preferred embodiment of the invention, the upper and lower parts define a recess communicating with the reservoir and containing a hollow member which both indicates the level of liquid in the reservoir and acts as a closure valve if the device is inverted or substantially tilted.

In a particular embodiment of the invention, the hollow member is a floating ball located by a number of upstanding posts within the recess.

The envelope sealing and feeding device according to the presently-preferred embodiment of the invention has a slot provided in its lower part whereby it may be connected by means of a plain flat bracket to a postage meter.

According to a preferred embodiment of the present invention, the upper and lower parts are made of moulded synthetic plastics material, and the wetter assembly has a housing which is moulded in one piece from synthetic plastics material.

The invention will be better understood from the following non-limiting description of a preferred example, given with reference to the accompanying drawings in which:

BRIEF DESCRIPTION OF THE DRAWINGS

FIGS. 1, 2 and 3 are respectively perspective views of upper (FIG. 1) and lower (FIG. 2) parts which together define a reservoir for a liquid and (FIG. 3) a perspective view showing the above two parts in assembled condition;

DETAILED DESCRIPTION OF THE PREFERRED EMBODIMENT

Figure 3:
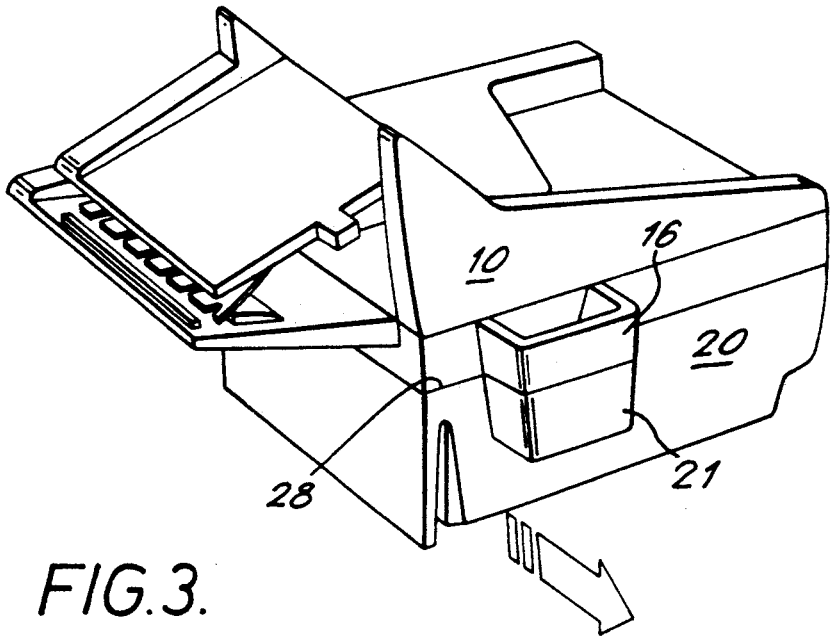
Figure 3A:
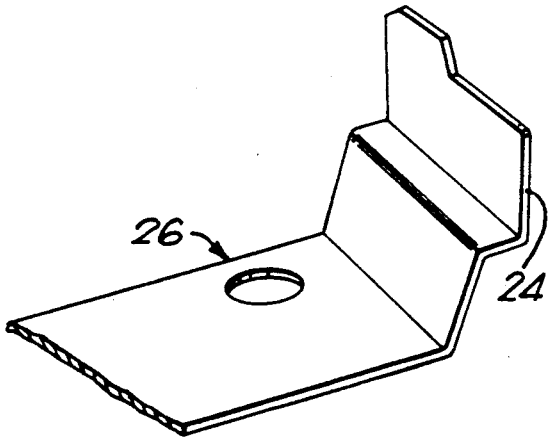
FIG. 3*a* being a view of one example of bracket by which the sealing device can be attached to a postage meter.

The illustrated envelope sealing device has an upper part 10 seen in FIG. 1 having an entry end 12 and an exit end 14. The exit end 14 is defined by an upper jaw 14A and a lower jaw 14B. On one side wall of the upper part there is a protruding portion 16, which is preferably made of transparent plastics material or has a window therein of such material. The upper part 10 of the housing seen in FIG. 1 effectively constitutes a lid or cover for a lower part 20 of the housing seen best in FIG. 2. The lower part 20 has a protruding portion 21 of matching size and shape to the portion 16 of FIG. 1. The lower part 20 defines a liquid-receiving container and includes two upstanding pillars 22 which have holes in their upper ends which are either threaded to receive securing bolts (e.g. bolts 22A) which hold the two parts 10, 20 together, or have holes to receive self-tapping screws which serve a similar purpose. The lower part 20 has a slot 23 extending across it towards one end. This slot receives a blade 24 of a bracket 26 by which the sealing device is attached to a suitable postage meter. FIG. 3 illustrates the assembled condition of the upper and lower parts 10, 20, the joining plane between these being indicated at 28. When assembled, the upper and lower parts 10, 20 define therein a reservoir into which liquid may be poured through an opening 16A in the protruding portion 16.

A hollow ball 25 is located within the protruding portion 21. Three vertical arms 27 limit the horizontal movement of the ball 25, but the ball 25 is free to rise and fall with the level of the liquid in the reservoir. The protruding portion 21 is transparent or has a window therein so that the ball 25 may be viewed to determine the level of the liquid in the reservoir. The ball 25 acts as a valve because, at its uppermost position, it seals the opening 16A.

Figure 5:
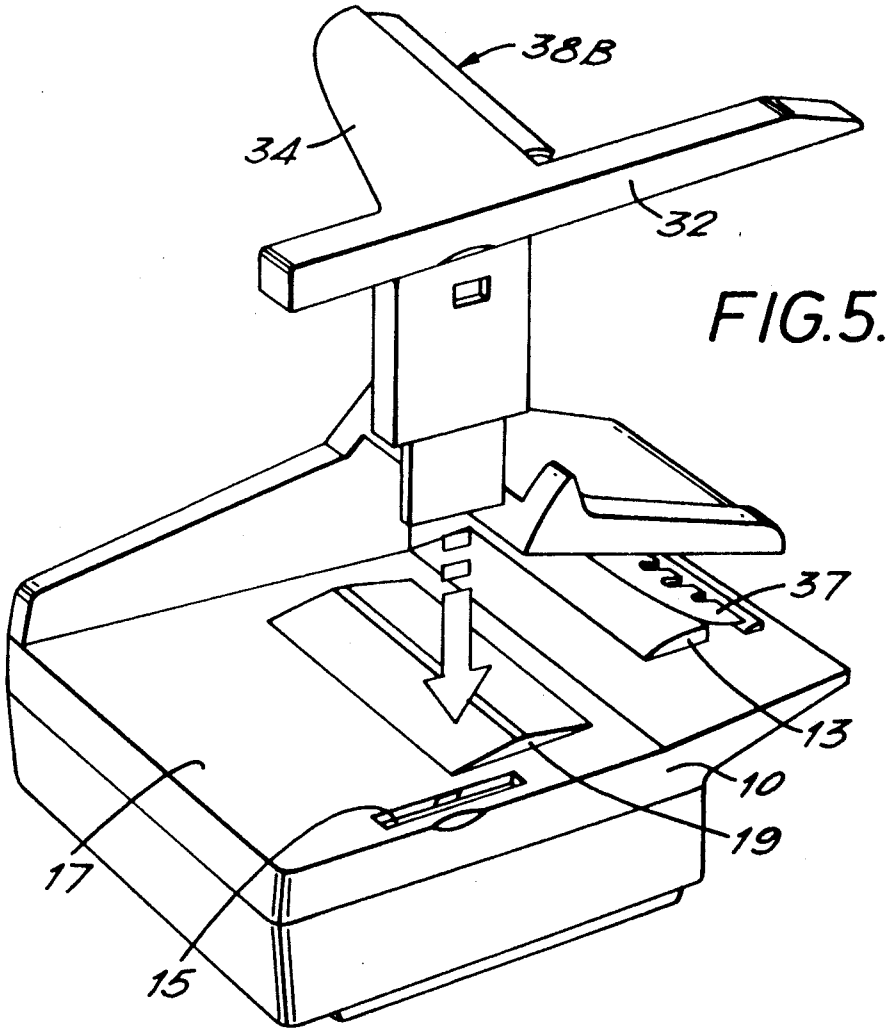
FIG. 5 is an isometric exploded view showing how the wetter assembly is fitted to the connected upper and lower parts.
Figure 4:
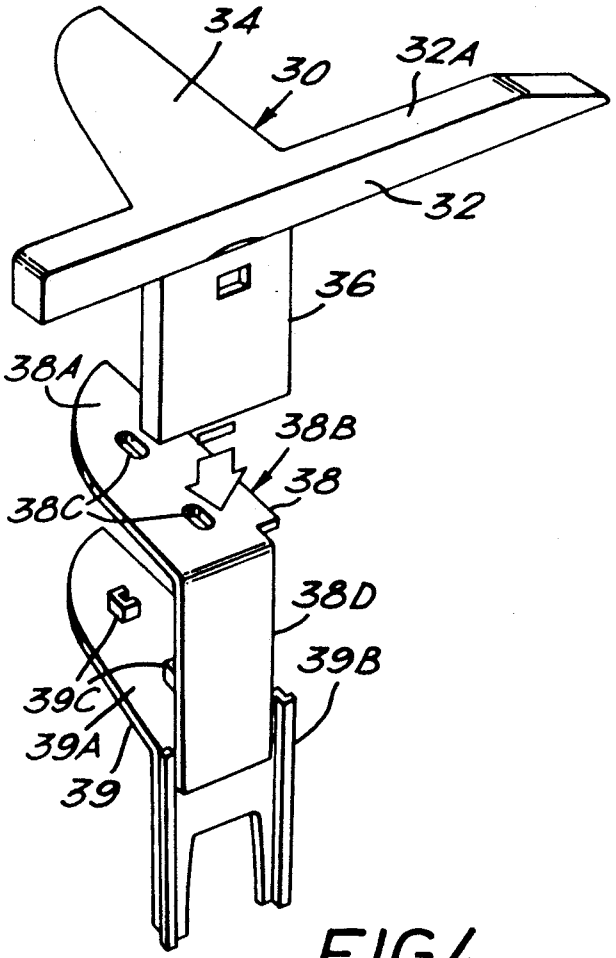
FIG. 4 is an isometric exploded view of a wetter assembly.

Referring now to FIGS. 4 and 5, a wetter assembly 30 includes a longitudinally extending wall portion 32, a laterally extending blade holder 34, and a downwardly extending tubular structure 36 whose purpose will appear from the following description. The portion 32 is shaped to have an upper surface 32A which is a smooth continuation of the laterally extending flat upper surface of the wetting blade holder 34. These surfaces constitute a support surface for an envelope travelling through the machine along the normal envelope travel path, that is, from right to left as seen in FIG. 1 or from left to right as seen in FIGS. 5 and 6.

The wetter assembly 30 includes a wick 38 which is made of suitable wicking material such as felt, and this wick has a horizontally extending portion 38A and a downwardly extending portion 38D. Part of the portion 38A extends beyond the edge of the wetting blade holder 34 to constitute a projecting lip 38B as seen best in FIGS. 4 and 5. There are holes 38C in the horizontally extending portion of the wick which receive locating projections 39C that extend upwardly from a generally horizontal portion 39A of a wick support and guide 39. This wick support has a downwardly extending portion 39B having front and rear walls. The downwardly extending portion 39B is chosen to accommodate the downwardly extending portion 38D of the wick and is dimensioned to be a snug fit when inserted into a slot 15 in the upper surface of the upper part 10 as seen best in FIG. 5.

The surface 17 of the upper part 10, which forms a roof for the liquid reservoir, has thereon a double ramp 19, seen best in FIG. 5, which causes envelopes being fed along the normal path through the sealer to be raised into close contact with the underside of the wetter assembly. This underside is formed by the horizontal portion 38A of the wicking material which, as a result of capillary action, has become wet due to upward migration of liquid from the reservoir to the portion 38A of the wick. As indicated, the edge or projecting lip 38B of the wicking material extends outwardly from the container defined by the conjoined parts 34 and 39. Continuing its travel, the envelope, whose flap has now been wetted, travels past a downwardly extending flap 37 which urges the envelope against a counter-support 13. Hence as the envelope leaves the sealer a light pressure is applied tending to hold the flap closed.

Figure 6:
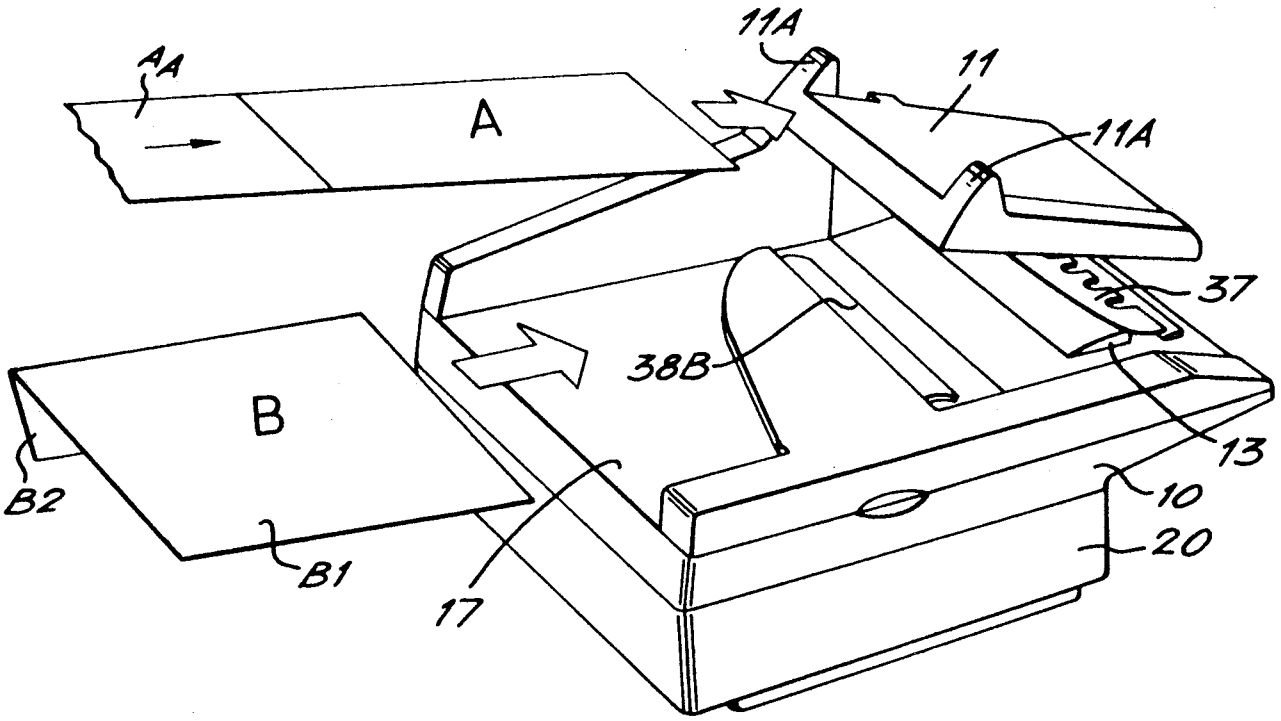
FIG. 6 is an isometric view of the completed envelope sealing device.

As seen best in FIG. 6, the sloping upper wall surface 11 of the upper part 10 is bounded at its entry end by two side ears 11A and these serve to guide a label A which is a self-adhesive label and which is carried in conventional manner on a support strip AA. When an envelope, seen at B in FIG. 6, is to be sealed, it is fed through the sealer with the body B1 of the envelope above the wetter assembly 30 and the flap B2 of the envelope located between the wetter assembly 30 and the surface 17 of the upper part 10. The upper surface of the flap B2 is accordingly wetted by the projecting lip 38B and, as the envelope leaves the sealer device, the flap is urged and held closed by its passage between the flap 37 and counter-support 13. The envelope is guided by the surface 17 of the upper part 10 in its passage through the machine.

It will be seen that the invention as particularly described herein makes certain advantages available for the first time. That is to say, replacement of the assembly that wets an envelope flap is made easier. Assembly and dis-assembly of the relevant parts of the machine in order to obtain access to the interior of the liquid reservoir can be done without difficulty. The upper and lower parts can be joined together readily merely by using two bolts or screws, and once joined the wetter assembly 30 can be added easily due to the simple structure, which allows easy preparation of the sub-assembly consisting of parts 34, 38 and 39 and then straightforward insertion of the tubular structure 36 in the slot 15. In addition, attachment of the envelope sealer-feeder device onto a postage meter is made particularly easy by the use of the bracket 26.

I claim:

1. An envelope sealing and feeding device comprising upper and lower interfitting parts defining a reservoir for a liquid to be used in the sealing operation and further defining a recess communicating with the reservoir and containing a hollow member which both indicates the level of liquid in the reservoir and acts as a closure valve if the device is inverted or substantially tilted;

said hollow member being a floating ball located by a number of upstanding posts within the recess; and a substantially horizontal slot through which an envelope to be sealed can be fed, these parts cooperating with a wetter assembly which includes a wetter blade extending across the slot and a tubular structure containing wicking material and extending substantially vertically downwardly through the upper part and into the liquid reservoir.

2. A device according to claim 1 in which the upper and lower parts are made of moulded synthetic plastics material, and the wetter assembly has a housing which is moulded in one piece from synthetic plastics material.

* * * * *